United States Patent [19]

Johnston et al.

[11] 4,046,717

[45] Sept. 6, 1977

[54] DETERGENT BARS

[75] Inventors: Gordon Francis Johnston, Ellesmere Port; Alexander Martin, Warrington; Alan Digby Tomlinson, Neston, all of England

[73] Assignee: Lever Brothers Company, New York, N.Y.

[21] Appl. No.: 678,784

[22] Filed: Apr. 21, 1976

Related U.S. Application Data

[63] Continuation of Ser. No. 438,043, Jan. 30, 1974, abandoned, which is a continuation-in-part of Ser. No. 324,622, Jan. 18, 1973, abandoned.

[30] Foreign Application Priority Data

Jan. 28, 1972 United Kingdom ..... 4180/72

[51] Int. Cl.[2] ..... C11D 3/33; C11D 3/20; C11D 17/00

[52] U.S. Cl. ..... 252/546; 252/89 R; 252/117; 252/132; 252/134; 252/174; 252/DIG. 5; 252/DIG. 16

[58] Field of Search ..... 252/DIG. 5, DIG. 16, 252/546, 89, 110, 117, 132, 134, 174

[56] References Cited

U.S. PATENT DOCUMENTS

| | | | |
|---|---|---|---|
| 2,300,413 | 11/1942 | Gaver | 252/132 |
| 2,894,912 | 7/1959 | Geitz | 252/DIG. 16 X |
| 3,376,229 | 4/1968 | Haass et al. | 252/DIG. 16 X |
| 3,663,459 | 5/1972 | Yoshida et al. | 252/546 |

FOREIGN PATENT DOCUMENTS

| | | |
|---|---|---|
| 830,238 | 3/1960 | United Kingdom |

*Primary Examiner*—Harris A. Pitlick
*Attorney, Agent, or Firm*—Melvin H. Kurtz

[57] ABSTRACT

A detergent or soap bar intended for personal washing is given a skin moisturizing effect by including a water soluble lactate and/or glutamate salt. Preferably at least 20% of the salt is present.

9 Claims, No Drawings

DETERGENT BARS

This application is a continuation of the previous application Ser. No. 438,043, filed Jan. 30, 1974, now abandoned, which in turn is a continuation-in-part of application Ser. No. 324,622, filed Jan. 18, 1973, now abandoned.

This invention relates to detergent bars for use in personal washing. The bars will contain materials selected from soaps, i.e., alkali metal salts of long-chain fatty acids and synthetic detergent actives.

It is known to increase the water retention of skin by incorporating in a lotion, intended for topical application, a moisturising component. This component increases the water holding capacity of the skin.

The applicants propose detergent bars consisting essentially of an additive effective to increase the water content of human skin which additive is selected from the groups i. from about 5% to about 55% by weight of a water soluble glutamate salt, ii. from about 5% to about 55% by weight of a mixture of a water soluble glutamate salt and a water soluble lactate salt, and iii. from at least 10% by weight to about 55% by weight of a water soluble lactate salt; the remainder being detergent active material and additives known for use in a detergent bar.

The water soluble salts will normally be alkali metal salts, for example sodium, potassium, or alkanolamine or ammonium salts.

The applicants have found that these components can be incorporated in detergent bars having usable physical properties. That is to say the properties, for example, mushing, extrudability and wear are sufficient for an acceptable bar. Further the applicants have found that these moisturizing components act on the skin in a rinse-off situation, i.e., one in which a washing bar is used to wash the skin the wash liquor rinsed off relatively soon after the washing stage.

Preferably the detergent bars of the invention contain at least 20% by weight lactate salt and at least 10% by weight glutamate salt. The presence of glutamates is preferable when the amount of lactate is above about 20% of the bar. Thus the bar may contain 10% of each component or 20% of lactate as alternative compositions. The lactate and glutamate salts may contain free acid dependent on the pH of the detergent active material. The term water soluble salt used herein includes any free acid which may be present.

Examples of detergent actives used to form this detergent bar of the invention are in the following classes (other actives are disclosed in "Surface Active Agents" by Schwartz & Perry published by Interscience in 1949 and volume II by Schwartz, Perry & Berch published by Interscience (1958):

a. isethionates containing an alkyl group having from 8 to 18 carbon atoms, such actives are termed "Igepon A" and may be derived from, for example, coconut fatty acids;

b. alkali metal salts of alkane sulphonates having an alkyl chain length of from 11 to 14, these actives are prepared by the reaction of a bisulphite ion species with an olefin;

c. sulphate of branched chain alcohols having chain lengths from 12 to 15, these alcohols are obtainable under the trade name "Dobanol";

d. alkylaryl sulphonates having an alkyl chain from $C_{10}$ to $C_{15}$;

e. dialkali metal salts of sulphonated saturated fatty acids having a chain length from $C_{12}$ to $C_{20}$;

f. ethoxylated alcohols ($C_{12}$ to $C_{20}$) having a degree of ethoxylation between 10 and 20;

g. alkyl ($C_{12}$ to $C_{18}$) sulphates, having a degree of branching at the alpha position of up to 25%;

h. alkene sulphonates having a chain length from $C_{14}$ to $C_{24}$;

i. alkali metal salts of $C_8$ to $C_{22}$ long chain fatty acids; and j. nonionic detergent actives, for example polyoxyalkylene derivatives of alcohols, alkyl amides and alkanol-amides, polyoxyalkylene esters of acids, alkylene oxide block polymers (e.g., PLURONICS), polyol esters and acyl alkanolamides.

Other examples of actives are amphoterics, betaines and cationics, e.g., ethoxylated quaternaries.

The bars may contain other materials, for example water, usually present in an amount up to 20%, pH controllers, germicides, perfumes and plasticizers.

The detergent bars of the invention may also contain other components which moisturize the skin during washing for example 2-pyrrolidone-5-carboxylic acid and its salts, hydrolyzed proteins, and salts of N-acetyl glycine.

Mixtures of the detergent actives can be used, for example i. a mixture of alkane sulphonates and alkene sulphonates as disclosed in UK Pat. specification No. 1,171,616, and ii. a mixture of tallow alcohol 18 EO and Igepon A.

The moisturizing component can be added at any stage in the processing of the bar provided the component is not subjected to processing steps leading to its degradation. The components may be added as the free acid or salt dependant on the pH of detergent active used, i.e., with a very alkaline active material the free acid may be added so that the salt is formed in the bar.

Examples of detergent bars of the invention will now be given.

The following test used damaged guinea pig corneum and the test method was as follows.

The rear footpads of guinea pigs are removed with a scalpel and incubated in buffered trypsin solution (pH 7.2) at 40° C overnight. The remaining corneum is washed in distilled water for 4 hours. Damage (reduction in water binding capacity) is affected by soaking the corneum in ether overnight followed by washing in distilled water for 6 hours. The corneum is then ready for use.

Pieces of corneum are soaked in 10% solutions of surfactant + moisturizer(s) for periods up to 30 minutes followed by a rinse in distilled water for up to 5 minutes. The corneum is patted dry and suspended in an atmosphere at 90% relative humidity for 6 days to equilibrate. The corneum is weighed and re-equilibrated for a further 6 days in a dry atmosphere before reweighing.

The water binding capacity is calculated and expressed as the amount of water held 100 mg dry corneum.

Test bars containing mixtures of the detergent active and the moisturizing components were made up by mixing the materials at the primary stage. All the bars prepared had acceptable physical properties. The results are quoted as the amount of water (in mg) bound by 100 mg of the dry corneum.

Bars were also tested in handwashing procedures and were found to give a moisturizing effect to the hands. The two components may exist in Dor L forms but the present invention does not depend on the optical isomer(s) used. The lactate used in the following Examples was a mixture of the two forms and the glutamate was the D-form.

EXAMPLE 1

Using sodium coconut isethionate a series of four bars were made up containing 10, 20 and 50% by weight of a 50:50 mixture of monosodium glutamate and lactate. The amounts of bound water were:

with nil moisturizer — 27.11
with 20% moisturizer — 31.72
with 30% moisturizer — 34.84
with 50% moisturizer — 41.38

EXAMPLE 2

A series of test bars were prepared using the actives and moisturizing components set out in Table I. The bars had satisfactory properties and the moisturizing property is demonstrated by the results in the Tables. The water binding capacities were measured using the test described previously. Alfol 14 is a $C_{14}$ primary alcohol.

| | | |
|---|---|---|
| Mixture A is | Sodium coconut isethionate | 54% |
| | Stearic acid | 25% |
| | Sodium tallow soap | 9% |
| | Sodium isethionate | 7% |
| | Sodium dodecylbenzene sulphonate | 3% |
| Mixture B is | Sodium coconut isethionate | 78% |
| | $C_{10}$–$C_{18}$ fatty acids | 22% |

EXAMPLE 4

A series of tallow soap bars were prepared containing 20, 30, 40 and 50% sodium lactate. The presence of the lactate was found to increase the moisturizing properties of the soap when used in handwashing test.

EXAMPLE 5

Water retaining tests were performed using a method is similar to that described by A C Park and C B Baddiel in the Journal of the Society of Cosmetic Chemists, Volume 26 (1972) pages 13 to 21. The measurements below the elastic modulus of guinea pig corneum is measured after soaking corneum in 4% solutions of the bars for periods up to 30 minutes followed by a rinse in distilled water for up to 5 minutes. The corneum was patted dry and suspended in an atmosphere at 80% relative humidity for 6 days to equilibrate. The elastic modulus was then measured, a reduction in modulus shows increase in water retention.

Bars made according to the invention used mixture B of Example 2.

Bars containing 5, 10, 20 and 40% sodium glutamate in a detergent base where found to increase the water binding capacity of corneum by measurement of elastic modulus and give a moisturizing effect in handwashing tests. The detergent base contained mixture 3 and soap (58% tallow 42% coconut) in a ratio of 1:1.

EXAMPLE 6

Bars containing 5, 10, 12, 15 and 18% of sodium lactate in a tallow soap, were found to increase water binding capacity of corneum when measured by elastic modulus and give a moisturizing effect on skin when used in handwashing tests.

EXAMPLE 7

Example I was repeated using ammonium salts and alkanolamine salts. The results are quoted below and show a significant increase in water retention when the salts of the present invention are used.

TABLE I

| ACTIVE(S) | | MOISTURISERS (SODIUM SALTS) LACTATE (%) | GLUTAMATE (%) | WATER BINDING CAPACITY (%) AFTER RINSING TEST SAMPLE | CONTROL (100% ACTIVE) |
|---|---|---|---|---|---|
| Sodium coconut isethionate 50% | Alfol 14 10% | 27 | 13 | 31.4 | 26.7 |
| Sodium coconut isethionate 43% | Alfol 14 10% | 27 | 20 | 31.6 | 26.7 |
| Mixture A 60% | — | 27 | 13 | 31.0 | 27.0 |
| Mixture A 65% | — | 17.5 | 17.5 | 31.2 | 27.0 |
| Mixture B 50% | — | 12.5 | 37.5 | 30.2 | 26.7 |
| Mixture B 50% | — | 37.5 | 12.5 | 30.2 | 26.7 |
| Mixture B 39% | Sodium tallow soap 21% | 27 | 13 | 34.0 | 27.0 |
| Mixture B 51% | Sodium tallow soap 9% | 27 | 13 | 31.7 | 27.0 |
| Mixture B 35% | Sodium tallow soap 35% | 22.5 | 7.5 | 33.5 | 26.7 |
| Sodium tallow soap 50% | | 12.5 | 37.5 | 32.2 | 26.7 |

EXAMPLE 3

Using sodium coconut isethionate as detergent active material a bar was made containing 50% of a 50:50 mixture of sodium-2-pyrrolidone-5-carboxylate and sodium lactate. The amounts of bound water were Nil moisturizer — 27.11
Test bar — 39.50

| Treatment Formulation | Water binding capacity (%) |
|---|---|
| 30% B, 30% C, 20% tri-isopropanolammonium lactate, 20% monosodium glutamate (MSG) | 34.9 |
| 60% B, 20% triethanolammonium lactate, 20% MSG | 33.9 |
| 60% B, 20% $C_6H_5(CH_3)_3N+$ lactate, 20% MSG | 31.8 |
| 30% B, 30% C, 20% triethanolammonium lactate, | |

-continued

| Treatment Formulation | Water binding capacity (%) |
|---|---|
| 20% MSG | 28.6 |
| 30% B, 30% C, 20% ammonium lactate, 20% MSG | 29.2 |
| 30% B, 30% C, 20% sodium lactate, 20% MSG | 33.3 |
| 100% B (control) | 22.4 |
| Difference required for significance (p = 0.05) | 5.4 |

Detergent active C was a mixture of the sodium salts of tallow and coconut fatty acids in a ratio of 4:1.

EXAMPLE 8

The method of Example 1 was used to determine the water binding capacity of a number of test formulations. The formulations were compared to control formulations in a number of experiments 1 to 6. It is seen from Table 2 the effect obtained by these salts is significant.

Table 2

| Test Formulations | Experiment | Water Binding Capacity (%) 1 | 2 | 3 | 4 | 5 | 6 |
|---|---|---|---|---|---|---|---|
| 18% sulphonated tallow/coconut acids (C), 20% B, 5.5% C, 7.5% fatty acid, 27% sodium lactate, 13% glutamate | | 34.4 | | | | | |
| 39% C, 17% sodium/potassium Dobanol sulphate, 4% coco-fatty acid, 27% sodium lactate, 13% glutamate | | 33.6 | | | | | |
| 45% alkane/olefin sulphonate, 9% cetyl/stearyl alcohol, 6% Alfol 14, 27% sodium lactate, 13% glutamate | | 33.4 | | | | | |
| 30% B, 30% C, 20% sodium lactate, 20% sodium glutamate | | 33.6 | | 33.3 | 29.6 | | |
| 35% B, 35% C, 20% sodium lactate, 10% sodium glutamate | | 30.5 | | | | | |
| 45% B, 15% C, 20% sodium lactate, 20% sodium glutamate | | | 37.5 | | | | |
| 35% B, 35% C, 15% sodium lactate, 15% sodium glutamate | | | 37.7 | | | | |
| 25% B, 45% C, 15% sodium lactate, 15% sodium glutamate | | | 37.7 | | | | |
| 30% B, 30% C, 15% sodium lactate, 25% sodium glutamate | | | 38.1 | | | | |
| 35% B, 35% C, 10% sodium lactate, 20% sodium glutamate | | | 34.4 | | | | |
| 60% B, 13% C, 27% sodium lactate | | | | 32.0 | | | |
| 35% B, 35% C, 30% sodium lactate | | | | | 30.6 | | |
| 37.5% B, 37.5% C, 25% sodium lactate | | | | | 30.6 | | |
| 32.5% B, 32.5% C, 35% sodium lactate | | | | | | 34.9 | |
| 80% C, 20% sodium lactate | | | | | | | 30.4 |
| Control Formulations | | | | | | | |
| 75% B, 25% C | | | | | | 28.4 | 26.5 |
| 100% B | | | 28.5 | 22.4 | | | |
| 100% C | | 23.2 | | | 22.1 | 28.1 | 27.3 |
| Difference required for significance (p = 0.05) | | 3.5 | 5.2 | 4.6 | 4.2 | 1.3 | 1.2 |

Preferably the additive or additives are present in an amount of at least about 30% and preferably the additives are present in a weight ratio range of from 1:3 to 3:1, preferably 1:2 to 2:1. These ranges are disclosed in the following part of this table.

| | % |
|---|---|
| 10% C, 7½% sodium lactate, 22½% MSG | 30.9 |
| 50% C, 12½% sodium lactate, 37½% MSG | 32.2 |
| 50% C, 37½% sodium lactate, 12½% MSG | 32.8 |
| 25% B, 25% C, 27½% sodium lactate, 12½% MSG | 33.5 |
| 50% B, 12½% sodium lactate, 37½% MSG | 30.2 |
| 50% B, 37½% sodium lactate, 12½% MSG | 30.2 |
| 100% B (control) | 26.6 |
| Significant Difference (95%) | 2.0 |

EXAMPLE 9

The method of Example 5 was repeated with the two differences that 10% solution was used for soaking and 90% humidity was used. The following formulations were tested and the elastic modulus measured and quoted in the units. Log (modulus $\times 10^{-5}$ dynes per square centimeter).

| | |
|---|---|
| 100% C | 3.20 |
| 90% C + 10% MSG | 3.07 |
| 95% C + 5% MSG | 3.03 |

-continued

| | |
|---|---|
| 90% C + 10% lactate | 2.88 |
| Significant Difference (95%) | 0.13 |

In the bars of this invention the amount of additive or additives is preferably above about 10%, preferably above about 20% and more preferably above about 30%. The amounts will usually be up to above 45%. The amount of detergent active will usually be in the range from about 45% to about 80%.

What is claimed is:

1. A detergent bar consisting essentially of
   a. an additive effective to increase the water content of human skin which additive is selected from the groups
      i. from about 5% to about 55% by weight of a water soluble salt of glutamic acid,
      ii. from about 5% to about 55% by weight of a mixture of a water soluble salt of glutamic acid and a water soluble lactate salt, and
      iii. from at least 12% by weight to about 55% by weight of a water soluble lactate salt; and
   b. from about 45% to about 95% by weight of detergent active material.

2. A detergent bar according to claim 1 wherein the detergent active material is present in an amount of from 45% to about 80%.

3. A detergent bar according to claim 1 which contains at least about 10% of the additive or additives.

4. A detergent bar according to claim 3 which contains at least about 20% of the additive or additives.

5. A detergent bar according to claim 4 which contains at least about 30% of the additive or additives.

6. A detergent bar according to claim 1 which contains up to about 45% of the additive or additives.

7. A detergent bar according to claim 1 which contains at least about 20% of the lactate salt and at least about 10% of the salt of glutamic acid.

8. A detergent bar according to claim 5 containing both lactate and salt of glutamic acid salts wherein the lactate and glutamate are present in a weight ratio range of from 1:3 to 3:1.

9. A detergent bar according to claim 8 wherein the weight ratio range is from 1:2 to 2:1.

* * * * *